United States Patent [19]

Benoit et al.

[11] 4,103,376

[45] Aug. 1, 1978

[54] SAFETY SIDE FOR HOSPITAL BED

[75] Inventors: Roland A. Benoit; Edmund P. Guillot, both of Danielson, Conn.

[73] Assignee: InterRoyal Corporation, New York, N.Y.

[21] Appl. No.: 782,485

[22] Filed: Mar. 29, 1977

Related U.S. Application Data

[63] Continuation of Ser. No. 626,798, Oct. 29, 1975, abandoned.

[51] Int. Cl.[2] ..... A47C 21/00

[52] U.S. Cl. ..... 5/331; 5/100

[58] Field of Search ..... 5/100, 331

[56] References Cited

U.S. PATENT DOCUMENTS

| | | | |
|---|---|---|---|
| 3,055,020 | 9/1962 | Mann | 5/331 |
| 3,100,899 | 8/1963 | Wright | 5/331 |
| 3,248,744 | 5/1966 | Hult | 5/331 |
| 3,851,345 | 12/1974 | Benoit et al. | 5/331 |

*Primary Examiner*—Casmir A. Nunberg
*Attorney, Agent, or Firm*—Arthur A. March

[57] ABSTRACT

Raisable safety side apparatus for one or both sides of a hospital bed comprising in each instance a corresponding side frame pivotally connected to lever means, e.g. a pair of spaced apart or parallel levers, adapted to be mounted operatively on a bed to move the side frame from a lower or inoperative position to an upper or operative position with respect to the bed, and resilient biasing means operatively interposed between the frame and the lever means to urge normally the frame to the upper position, e.g. a longitudinal bilateral resilient biasing member mounted intermediate its ends on the frame and operatively connected at its ends to the corresponding levers, such as crank levers, whereby to bend the bilateral biasing member out of its normal longitudinal disposition as the levers move the frame from the upper position to the lower position against the resilient force of such bilateral biasing member; and optionally including means to limit the pivotal movement between the frame and the lever means upon moving the frame to the upper position, and releasable locking means to maintain the frame in the upper position.

9 Claims, 4 Drawing Figures

FIG. 3
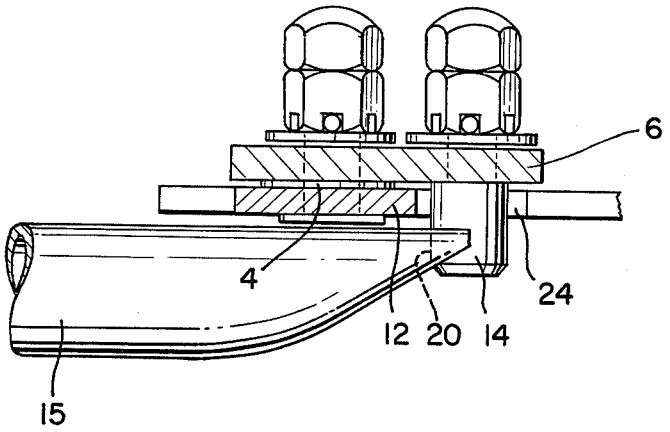
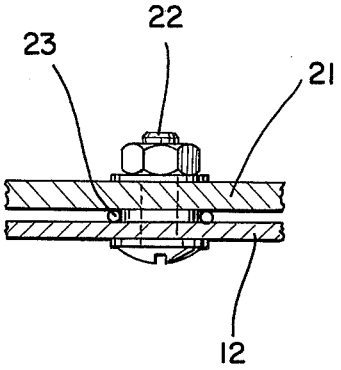
FIG. 4

SAFETY SIDE FOR HOSPITAL BED

This is a continuation of application Ser. No. 626,798, filed Oct. 29, 1975, now abandoned.

The present invention relates to a raisable safety side apparatus for one or both sides of a hospital type bed, and more particularly to such an apparatus including a side frame, lever means and resilient biasing means operatively interposed between the side frame and lever means to urge normally the side frame to the upper position.

Many safety side constructions of the type usable on hospital beds are known. Problems with these include considerations of the relative cost and intricacy of necessary parts and mechanisms, and corresponding production expenses and difficulties, and the possible need for special complex controls to manipulate the side frame component of the construction, especially those requiring potentially dangerous electrically operated integral or collateral equipment. Moreover, apart from overall drawbacks such as limited useful life and accidental damage to attendant delicate parts and controls, these known safety side constructions do not contemplate effortless manual movement by the patient of the side frame itself in order to raise and lower it.

It is an object of the present invention to overcome the foregoing disadvantages and to provide a safety side apparatus for a hospital type bed or the like which involves a minimum of coacting parts, which is convenient and inexpensive to produce, which is rugged and durable in its service life, which is simple in construction and operation, and which avoids potential patient dangers caused by otherwise attendant electrically operated equipment and controls.

It is another object of the invention to provide such an apparatus having a side frame which is able to be manually raised and lowered substantially effortlessly, even by the bed patient himself.

It is still another object of the invention to provide such an apparatus which self-limits the upward movement of the side frame when it is raised to the upper position, and optionally which self-locks releasably the side frame when moved to the upper position so as to prevent inadvertent or undesired downward movement to the lower position.

It is a further object of the invention to provide such an apparatus utilizing the self-storing potential reserve resilient or spring force of operatively interposed resilient biasing means in the constructional system, aided by the weight of the side frame and its momentum during downward movement whereby to accumulate such potential reserve force, for facilitating upward return of the side frame to the upper position.

Other and further objects of the invention will become apparent from a study of the within specification and drawings, in which:

FIG. 3 is a schematic downward section taken along the lines 3—3 of FIG. 1; and

FIG. 4 is a schematic downward section taken along the lines 4—4 of FIG. 1.

Figure 2:
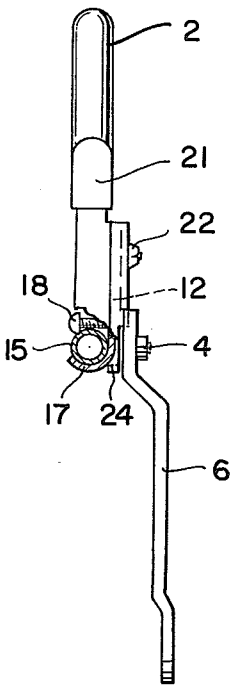
FIG. 2 is a schematic end view of the apparatus of FIG. 1 as seen from the right side and partially broken away to illustrate details of construction.

According to the present invention a safety side apparatus for a hospital bed or the like is provided, which comprises generally a side frame on one or both sides of the bed, each pivotally connected to lever means adapted to be mounted operatively on the bed at that corresponding side to move the frame from a lower position to an upper position with respect to the bed, and resilient biasing means operatively interposed between the side frame and the lever means to urge normally the frame to the upper position. Preferably, means such as upper position pivot limiting means are provided to limit the pivotal movement between the side frame and lever means upon moving the frame to the upper position. Also, releasable locking means such as optionally automatically self-locking releasable means are preferably provided to maintain the side frame in the upper position upon being raised thereto from the lower position.

Advantageously, the resilient biasing means may include a longitudinal resilient or spring member operatively interposed between the side frame and the lever means, and the lever means may include cooperatingly a pair of spaced apart or parallel levers. By providing the longitudinal resilient biasing member as a bilateral resilient biasing member, the same may be conveniently mounted intermediate its ends on the side frame and operatively connected at its ends to the corresponding levers, whereby to bend such bilateral member out of its normal longitudinal disposition as the levers move the frame from the upper position to the lower position against the resilient force of the bilateral member.

The lever means are preferably provided in the form of a pair of spaced apart or parallel crank levers, each adapted to be mounted operatively at one portion thereof on the bed and each having a floating frame pivot point and a biasing pivot point radially spaced from the frame pivot point at another portion thereof spaced from the first portion thereof. Thus, the side frame may be pivotally connected to the levers at the corresponding frame pivot points and the resilient biasing means, e.g. the bilateral resilient member, may be operatively connected to the levers at the corresponding biasing points whereby to urge normally the frame pivot points and in turn the side frame to the upper position.

Desirably, the resilient biasing means may be operatively interposed between the side frame and the lever means in compression loaded condition. This will increase the mechanical advantage of the constructional system since the reserve spring force will facilitate return of the side frame to the upper position, both in terms of the pre-loaded compression force and the added counterforce to the bending or deformation of the resilient biasing means caused by the downward movement of the frame when moved to the lower position.

With respect to the crank lever feature of the invention, the upper position pivot limiting means may be arranged to limit the pivotal movement between the side frame and the crank levers about the frame pivot points upon moving the frame to the upper position. Also, the locking means may include a catch arm pivoted to the frame and engagable, preferably under a resilient or spring biasing force, with one of the crank levers such as at the corresponding biasing point of the crank lever to achieve such releasable locking of the frame.

Figure 1:
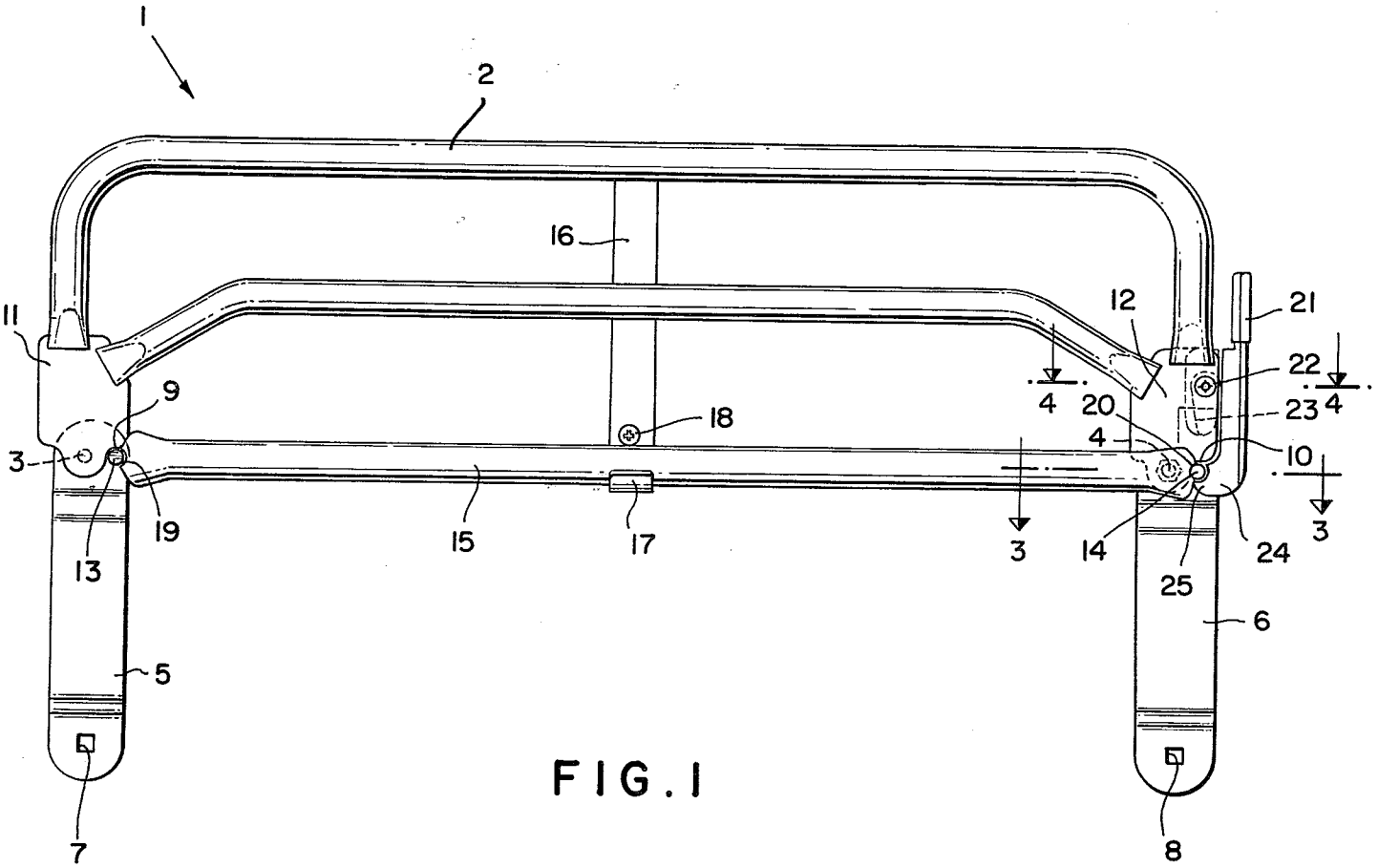
FIG. 1 is a schematic side elevation of the safety side apparatus for a hospital type bed according to an embodiment of the invention.

Referring to the drawing, and especially FIG. 1, a safety side apparatus 1, according to the invention, is shown, which may be mounted on a corresponding side in the usual way of a hospital type bed or the like (not shown) to prevent the patient from inadvertently falling out of bed. It is preferred, of course, that a safety side apparatus according to the invention be provided at each side of the bed for maximum protection. Generally, the safety side apparatus 1 includes a floating safety rigid side frame 2, for instance, containing one or two tubular side defining portions of the usual type, pivotally connected at floating frame pivot points 3 and 4 to the pair of spaced apart crank levers 5 and 6, which in turn are adapted to be mounted operatively on a bed (not shown) via bed pivots at bed pivot points 7 and 8.

Advantageously, pivot points 3 and 7 are correspondingly equally spaced laterally from pivot points 4 and 8, and pivot points 3 and 4 are correspondingly equally spaced vertically from pivot points 7 and 8, so that crank levers 5 and 6 pivotally mount frame 2 in parallelogram fashion for lowering and raising frame 2 in the desired manner. Thus, while pivot points 7 and 8 are normally situated at the lower ends of crank levers 5 and 6 and pivot points 3 and 4 are normally situated at the upper ends thereof, it will be realized that the crank levers may take any desired operative form or shape so long as the above parallelogram disposition of the corresponding pivot points is maintained for achieving movement of the frame from the upper or operative position as shown in FIG. 1 to lower or inoperative position there below (not shown) and vice versa, i.e. with respect to the bed.

Upper position pivot limiting means, for example in the form of limiting shoulders 9 and 10, are correspondingly defined on frame plates 11 and 12, which latter constitute connecting parts of rigid frame 2 for pivoting the frame about frame pivot points 3 and 4 on crank levers 5 and 6. Shoulders 9 and 10 serve to limit the pivotal movement between frame 2 and crank levers 5 and 6 upon moving the frame to the upper position, i.e. in a direction to the left as viewed in FIG. 1. For this purpose in part, crank pins 13 and 14, correspondingly mounted on crank levers 5 and 6, are located at corresponding biasing pivot points equally radially spaced from the adjacent corresponding frame pivot points 3 and 4. At selective maximum upward movement of frame 2, crank pins 13 and 14 will abut shoulders 9 and 10 on frame plates 11 and 12 to prevent further relative pivotal movement between frame 2 and crank levers 5 and 6, i.e. about frame pivot points 3 and 4.

Resilient biasing means, such as in the form of a longitudinal or tubular resilient biasing member 15, are operatively interposed between frame 2 and crank levers 5 and 6 so as to urge normally frame 2 to the upper or operative position with respect to the bed. Resilient biasing member 15 is advantageously provided as a bilateral resilient biasing or tubular spring member mounted intermediate its ends on frame 2 via depending center frame strap 16. Strap 16 is provided with retaining means such as underside retaining seat 17 and overlying retaining screw 18 whereby to mount bilateral resilient biasing member 15 intermediate its ends on the frame in any loaded or unloaded operative disposition of the resilient member corresponding to any position of relative movement of the frame and the crank levers. Pin engaging notches 19 and 20 are provided on the ends of bilateral resilient biasing member 15 for correspondingly operatively engaging crank pins 13 and 14 on crank levers 5 and 6 at the respective biasing pivot points, i.e. radially spaced from the adjacent frame pivot points 3 and 4 thereat. In this way, the bilateral resilient biasing member 15 will bend out of its normal longitudinal axial disposition via engagement with crank pins 13 and 14 as crank levers 5 and 6 move the frame 2 from the upper position as shown in FIG. 1, in a direction to the right, to the lower position against the resilient force of such bilateral biasing member, yet the latter will normally urge the frame pivot points 3 and 4 and in turn frame 2 to the upper position. Advantageously, the resilient biasing member can thus form an auxiliary tubular side defining portion of the floating safety side frame itself.

Releasable locking means to maintain frame 2 in the upper position may be provided, such as in the form of catch arm 21 pivoted to frame plate 12 at 22, preferably under the urging bias of wire spring 23 operatively loaded between catch arm 21 and frame plate 12. Catch arm 21 is engagable with crank lever 6, for instance at crank pin 14. Advantageously, by aligning pivot 22 directly above frame pivot point 4 and in turn locking finger 24 on catch arm 21 directly there below, locking finger 24 will lockingly engage crank pin 14 in a positive locking manner. In order to achieve automatically a self-relocking condition, a self-relocking cam edge 25 is provided on the underside of locking finger 24 for operative contact with crank pin 14 during movement of frame 2 to the upper position whereby to pivot catch arm 21 against the resilient biasing force of spring 23 sufficiently to permit crank pin 14 to pass by and clear the catch arm. The catch arm will thereafter return under the force of spring 23 to engage lockingly crank pin 14 thereat.

In this regard, by laterally offsetting frame pivot points 3 and 4 on the upper end portions of crank levers 5 and 6, i.e. to the left as viewed in FIG. 1, with respect to the corresponding position of bed pivot points 7 and 8 on the lower end portions of such crank levers, the weight of frame 2 will urge crank pins 13 and 14 against limiting shoulders 9 and 10. This will serve to keep frame 2 in static raised position, especially under the attendant resilient force of bilateral biasing member 15 which normally urges frame 2 to the upper position. The provision for catch arm 21 to lock the frame releasably in the upper position thus insures that static disposition until the locking means are pivotally released and the frame urged to the right, as viewed in FIG. 1, to lower the same via the parallelogram linkage of crank levers 5 and 6 pivotally connected at frame pivot points 3 and 4 and at bed pivot points 7 and 8. It will be appreciated that such offset parallelogram linkage, as shown in FIG. 1, will take the geometric form of a rhomboid rather than a right rectangle.

Hence, the basic elements include floating rigid side frame 2, the pair of spaced apart crank levers 5 and 6, each adapted to be mounted operatively at one portion thereof on the hospital bed or the like via bed pivot points, 7 and 8, and each having a floating frame pivot point, 3 and 4, and a biasing pivot point, at crank pins 13 and 14, radially spaced from the corresponding frame pivot points, at another portion of such crank levers spaced from the first portion thereof, the frame being pivotally connected at corresponding longitudinally spaced apart fixed distance pivot locations thereon to the crank levers at the corresponding frame pivot points to move the frame from a lower or inoperative position to an upper or operative position with respect to the bed, and a bilateral longitudinal resilient biasing member 15, mounted intermediate its ends on frame 2 at depending strap 16 between underside retaining seat 17 and overlying retaining screw 18, and operatively connected at its ends via notches 19 and 20 and crank pins 13 and 14 to crank levers 5 and 6 at the corresponding biasing points thereon. In this way, bilateral biasing member 15 will bend out of its normal longitudinal or axial disposition as the crank levers move the frame from the upper position to the lower position against the resilient force of the bilateral member while the latter will urge normally the frame pivot points and in turn the frame to the upper position.

The bilateral resilient biasing member thus serves as a self-storing reserve spring force agency which facilitates reraising of the frame to upper or operative position. By the further optional yet obviously preferred feature of operatively connecting the bilateral biasing member between the frame and the crank levers in compression loaded condition, e.g. by pre-compression loading the bilateral biasing member 15 via notches 19 and 20 between suitably dimensioned and spatially positioned crank pins 13 and 14 on crank levers 5 and 6 and maintaining bilateral biasing member 15 between retaining seat 17 and retaining screw 18 on frame strap 16, the normal reserve spring force of resilient bilateral member 15 for the raising of frame 2 is enhanced by the added, preferably slight, pre-compression loading spring force inherent in the bilateral member. A counter-balanced resilient spring force loading of the floating frame system is thereby provided.

Accordingly, the apparatus of the present invention involves a minimum of coacting parts and is convenient and inexpensive to produce, as well as rugged and durable in its extensive service life. The arrangement is simple in construction and operation, and obviates potential patient dangers which might otherwise be caused by attendant electrically operated equipment and controls since the present invention is entirely manually operated. The system is such that the apparatus self-limits the upward movement of the side frame when it is raised to the upper position and preferably self-locks releasably the side frame automatically when moved to the upper position so as to prevent inadvertent or undesired downward movement to the lower position. The self-storing potential reserve resilient or spring force of the operatively interposed resilient biasing means in the constructional system is advantageously utilized to facilitate upward return of the side frame to the upper position. This is aided by the weight of the side frame and its momentum during downward movement whereby to accumulate such potential reserve force. In this way, even the bed patient himself is able manually to raise and lower the side frame substantially effortlessly due to its inherent more or less self-counterbalancing resilient biasing system as provided. Moreover, the resilient biasing means are contemplated in such form and spatial disposition as to constitute a protecting side wall part of the floating safety side or side frame itself and to be entirely contained within the dimensional confines of the remainder of the apparatus parts.

It will be realized that the foregoing specification and drawings are set forth by way of illustration and not limitation, and that various modifications and changes may be made therein without departing from the spirit and scope of the present invention which is to be limited only by the scope of the appended claims.

What is claimed is:

1. Safety side apparatus for a hospital bed comprising:

a longitudinally extending rigid side frame having a pair of longitudinally spaced apart fixed distance pivot locations thereon, a pair of longitudinally spaced apart crank levers, each adapted to be mounted operatively at one portion thereof on the bed and each having a floating frame pivot point and a biasing crank pivot point radially spaced from the frame pivot point at another portion thereof spaced from the first portion thereof, the frame being pivotally connected at the fixed pivot locations thereon to the levers at the corresponding frame pivot points of the levers to move the frame from a lower position to an upper position with respect to the bed, intermediately disposed retaining means on the frame, and a bilateral longitudinal resilient biasing member operatively mounted intermediate its ends on the frame by the retaining means and operatively connected at its ends to the levers at the corresponding biasing crank pivot points and arranged with respect to the levers for bending the bilateral member out of its normal longitudinal disposition as the levers rotate about the floating frame pivot points with respect to the frame at the fixed distance pivot locations thereon to move the frame from the upper position to the lower position against the resilient force of the bilateral member exerted on the levers operatively connected to the ends of the bilateral member at the biasing crank pivot points and which force normally urges the frame pivot points of the levers and in turn the frame at the fixed distance pivot locations thereon to the upper position.

2. Apparatus according to claim 1 wherein a depending strap is provided on the frame which carries the retaining means, and the retaining means mounts the bilateral member intermediate its ends on the frame in any operative disposition thereof corresponding to any position of relative movement of the frame and the levers.

3. Apparatus according to claim 1 wherein upper position pivot limiting means are provided to limit the pivotal movement between the frame and the levers about the floating frame pivot points upon moving the frame to the upper position.

4. Apparatus according to claim 3 wherein releasable locking means are provided to maintain the frame in upper position.

5. Apparatus according to claim 4 wherein the locking means include a catch arm pivoted to the frame and operatively engageable with one of the levers.

6. Apparatus according to claim 5 wherein the catch arm is operatively engageable with engageable means on one of the levers at its corresponding biasing crank pivot point.

7. Apparatus according to claim 6 wherein the catch arm is normally resiliently biased into such operative engagement.

8. Apparatus according to claim 7 wherein the catch arm is provided with a self-relocking cam edge for such operative engagement during movement of the frame to the upper position to pivot the catch arm against the resiliently biasing force thereof sufficiently to permit the engageable means on such lever to pass the catch arm and the catch arm thereafter to engage lockingly the engageable means.

9. Apparatus according to claim 1 wherein the bilateral member is operatively interposed in compression loaded condition between the corresponding biasing crank pivot points of the levers.

* * * * *